US007268741B2

(12) United States Patent
Sarabandi et al.

(10) Patent No.: US 7,268,741 B2
(45) Date of Patent: Sep. 11, 2007

(54) COUPLED SECTORIAL LOOP ANTENNA FOR ULTRA-WIDEBAND APPLICATIONS

(75) Inventors: Kamal Sarabandi, Ann Arbor, MI (US); Nader Behdad, Ann Arbor, MI (US)

(73) Assignee: EMAG Technologies, Inc., Ann Arbor, MI (US)

( * ) Notice: Subject to any disclaimer, the term of this patent is extended or adjusted under 35 U.S.C. 154(b) by 134 days.

(21) Appl. No.: 11/208,700

(22) Filed: Aug. 22, 2005

(65) Prior Publication Data

US 2006/0055619 A1 Mar. 16, 2006

Related U.S. Application Data

(60) Provisional application No. 60/609,381, filed on Sep. 13, 2004.

(51) Int. Cl.
*H01Q 21/00* (2006.01)

(52) U.S. Cl. ..... 343/866; 343/867; 343/795

(58) Field of Classification Search ..... 343/866, 343/867, 700 MS, 846, 795, 830, 873, 844
See application file for complete search history.

(56) References Cited

U.S. PATENT DOCUMENTS 5,506,592 A * 4/1996 MacDonald et al. ..... 343/846
6,512,488 B2 * 1/2003 Schantz ..... 343/795
6,774,859 B2 * 8/2004 Schantz et al. ..... 343/742

* cited by examiner

*Primary Examiner*—Hoanganh Le
(74) *Attorney, Agent, or Firm*—John A. Miller, Esq.; Miller IP Group, PLC

(57) ABSTRACT

A single-element antenna system that provides a wide bandwidth and consistent polarization over the frequency range to which the antenna is impedance matched. In one embodiment, the wideband antenna system includes two parallel coupled sectorial loop antennas (CSLA) that are coupled along an axis of symmetry. In another embodiment, half of the coupled sectorial loop antenna is electrically coupled to a ground plane, where the antenna includes one pie-slice shaped sector and two arches. In alternate embodiments, sections of the sector can be removed to reduce the weight of the antenna system.

30 Claims, 9 Drawing Sheets

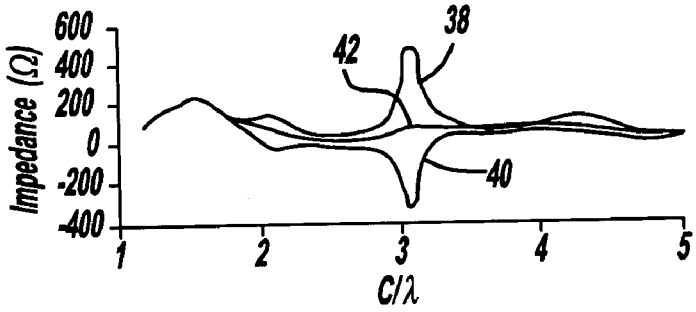
FIG - 4a
FIG - 4b
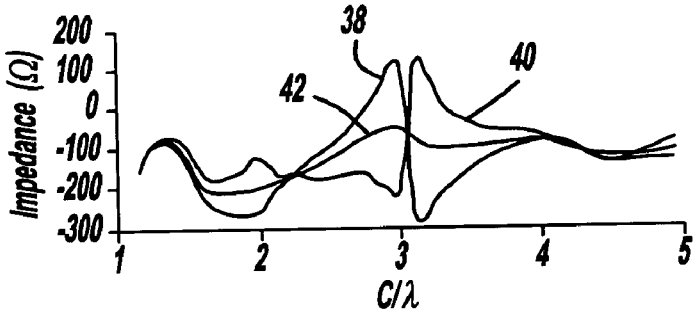
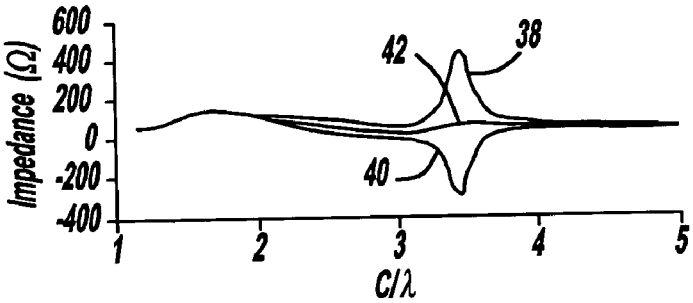
FIG - 4c
FIG - 4d
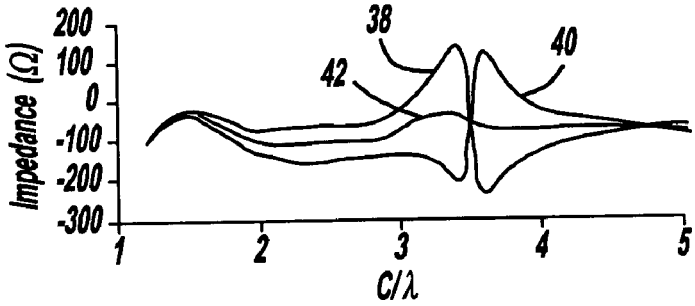

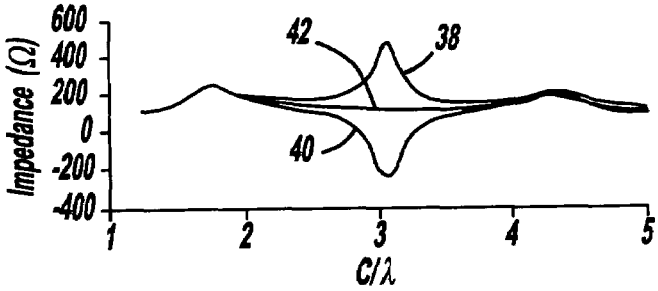
FIG - 4e
FIG - 4f
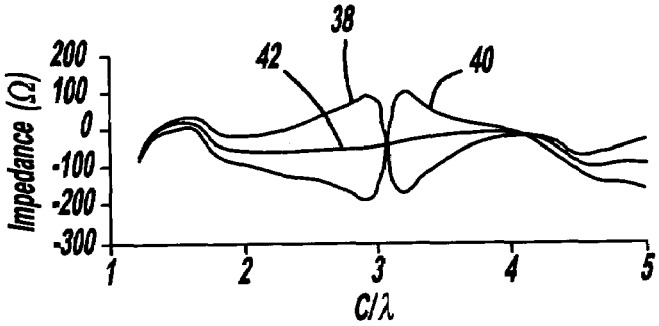
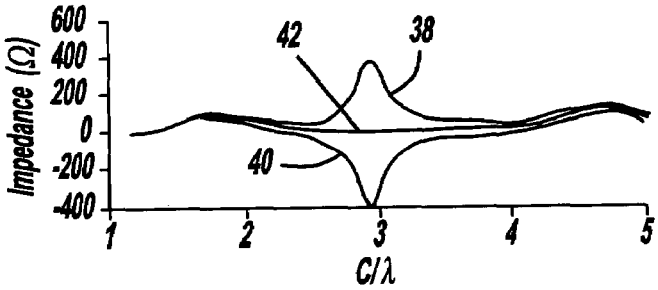
FIG - 4g
FIG - 4h
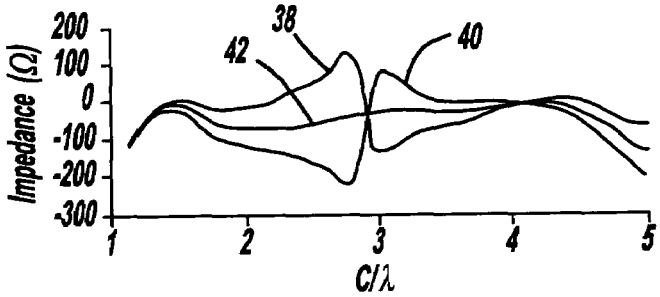

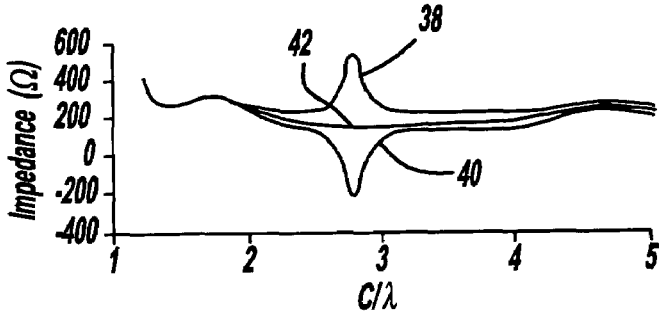
FIG - 4i
FIG - 4j
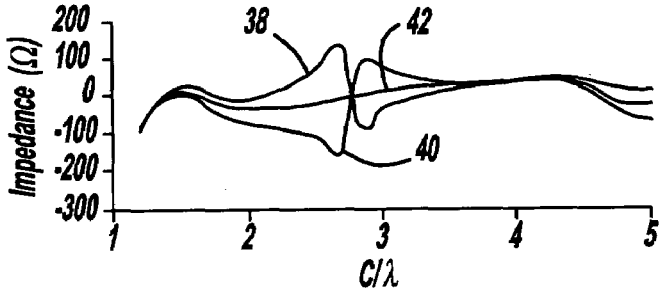
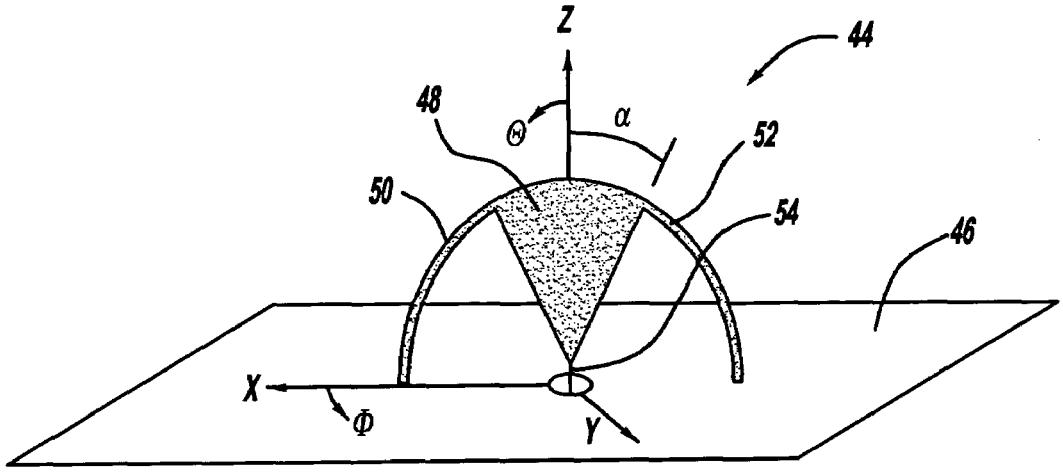
FIG - 5

COUPLED SECTORIAL LOOP ANTENNA FOR ULTRA-WIDEBAND APPLICATIONS

CROSS REFERENCE TO RELATED APPLICATIONS

This application claims the benefit of the filing date of U.S. Provisional Application No. 60/609,381, titled Coupled Sectorial Loop Antenna for Ultra-Wideband Applications, filed Sep. 13, 2004.

BACKGROUND OF THE INVENTION

1. Field of the Invention

This invention relates generally to compact and ultra-wideband antennas and, more particularly, to coupled sectorial loop antennas (CSLA) for ultra-wideband applications.

2. Discussion of the Related Art

Various applications for ultra-wideband (UWB) wireless systems are known in the art, including ground penetrating radar, high data rate short range wireless local area networks, communication systems for military applications, UWB short pulse radars for automotive and robotics applications, etc. UWB wireless systems require antennas that are able to operate across a very large bandwidth with consistent polarization and radiation pattern parameters over the entire band. Various techniques are known in the art to design antennas with wideband impedance matched characteristics.

Traveling wave antennas and antennas with topologies that are invariant by rotation are inherently wideband and have been extensively used in the art. Self-complimentary antenna concept provides a constant input impedance irrespective of frequency, provided that the size of the ground plane for the slot segment of the antenna is large and an appropriate self-complimentary feed can be designed. Theoretically, the input impedance of self-complimentary antennas is 186 ohms, and thus, these antennas cannot be directly matched to standard transmission lines having a 50 ohm impedance. Another drawback of self-complimentary antenna structures is that they cannot be printed on a dielectric substrate because the dielectric constant of the substrate perturbs the self-complimentary condition.

Another technique for designing wideband antennas is to use multi-resonant radiation structures. Log-periodic antennas, microstrip patches with parasitic elements, and slotted microstrip antennas for broadband and dual-band applications are examples of such multi-resonant radiating structures.

The electric dipole and monopole above a ground plane are perhaps the most basic types of antennas. Variations of these antennas have recently been introduced for obtaining considerably larger bandwidths than the traditional dipole and monopole antenna designs. Impedance bandwidth characteristics of circular and elliptical monopole plate antennas are also known in the art. Wideband characteristics of rectangular and square monopole antennas are also known, and a dielectric loaded wideband monopole has been investigated in the art. One drawback of these types of antennas is that the antenna polarization as a function of frequency changes.

SUMMARY OF THE INVENTION

In accordance with the teachings of the present invention, a single-element antenna system is disclosed that provides a wide bandwidth and consistent polarization over the frequency range to which the antenna is impedance matched. In one embodiment, the wideband antenna system includes two parallel coupled sectorial loop antennas (CSLA) that are coupled along an axis of symmetry. In another embodiment, half of the coupled sectorial loop antenna is electrically coupled to a ground plane, where the antenna includes one pie-slice shaped sector and two arches. In an alternate embodiment, sections of the sector can be removed to reduce the weight of the antenna system. In another embodiment, the antenna system includes overlapping traces on opposite sides of a substrate.

Additional features of the present invention will become apparent from the following description and appended claims, taken in conjunction with the accompanying drawings.

BRIEF DESCRIPTION OF THE DRAWINGS

FIGS. 4(*a*)-4(*j*) are graphs with C/λ on the horizontal axis, where $C=2\pi R_{out}$, and impedance on the vertical axis showing self and mutual impedances of the SLAs shown in FIG. 2 that are 0.01 λ apart;

FIG. 5 is a perspective view of a CSLA and associated ground plane, according to another embodiment of the present invention;

DETAILED DESCRIPTION OF THE EMBODIMENTS

The following discussion of the embodiments of the invention directed to wideband coupled sectorial loop antennas is merely exemplary in nature, and is in no way intended to limit the invention or its applications or uses.

The equivalent circuit for a loop antenna, at its first resonance, is a shunt RLC circuit where the resistance represents the ohmic loss in the loop and the radiation resistance. The equivalent circuit parameters in general are functions of frequency. The variation of the capacitance as a function of frequency determines whether it is possible to control the spectral variation of the equivalent circuit inductance in such a way that a resonance condition is satisfied over a wide range of frequencies.

Figure 1:
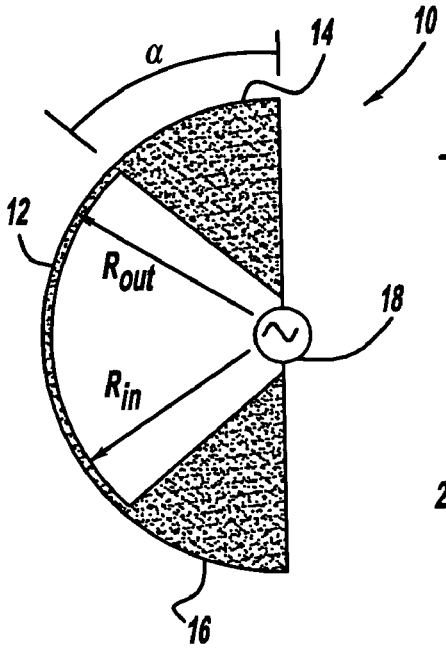
FIG. 1 is a plan view of a sectorial loop antenna, according to an embodiment of the present invention.

FIG. 1 shows a narrow-band sectorial loop antenna (SLA) 10 including an arch 12 and two pie-slice shaped sectors 14 and 16, according to an embodiment of the present invention. An AC feed 18 feeds the two sectors 14 and 16. The input impedance $Z_s$ of the SLA 10 is a function of three geometrical parameters $R_{in}$, $R_{out}$ and $\alpha$, where $R_{in}$ is the inner radius of the arch 12, $R_{out}$ is the outer radius of the arch 12 and $\alpha$ is the arc angle in degrees of the sectors 14 and 16. The SLA 10 has a resonance behavior that is inductive below and capacitive above a first resonance.

Although not particularly shown in some of the several embodiments discussed herein for clarity purposes, the various arches and sectors of the sectorial loop antennas are metallized layers on a suitable dielectric substrate, as will be appreciated by those skilled in the art.

Figure 2:
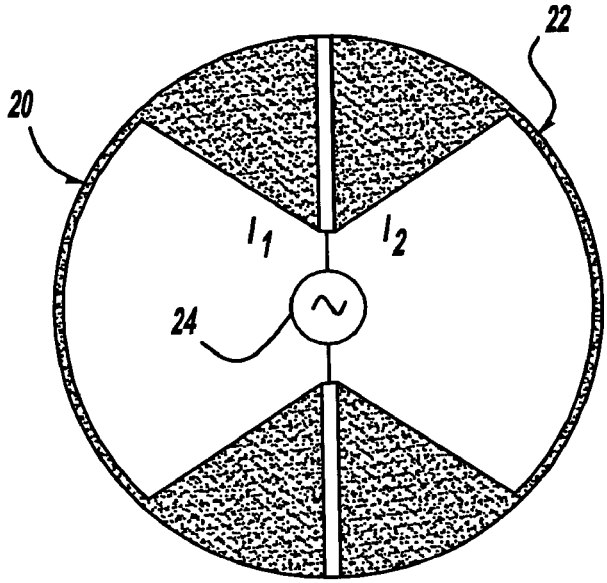
FIG. 2 is a plan view of two parallel sectorial loop antennas that are proximity coupled to each other.

One way of controlling the self-impedance of the SLA 10 is by introducing an adjacent SLA with sufficient mutual coupling. This can be accomplished by connecting two identical SLAs 20 and 22 in parallel, as shown in FIG. 2. In this application, a single AC feed 24 feeds all four of the sectors of the SLAs 20 and 22. In this case, because of the symmetry, the input currents $I_1$ and $I_2$ are equal, but the direction of the magnetic field of the SLA 20 is in the opposite direction of the magnetic field of the SLA 22. Therefore, the magnetic flux of the SLAs 20 and 22 can be linked to provide a strong mutual coupling. The geometrical parameters can be varied to control the mutual coupling as a function of frequency.

For the two-port system of the SLAs 20 and 22, the following equations can be provided:

$$V_1=Z_{11}I_1+Z_{12}I_2 \tag{1}$$

$$V_2=Z_{21}I_1+Z_{22}I_2 \tag{2}$$

Where $V_1$, $I_1$, $V_2$ and $I_2$ are the voltages and currents at the input ports of the SLA 20 and the SLA 22, respectively. $Z_{11}$ ($Z_{22}$) is the input impedance of the SLA 20 (22) in the presence of the SLA 22 (20) when it is open circuited. $Z_{21}$ and $Z_{12}$ represent the mutual coupling between the SLAs 20 and 22. Reciprocity mandates $Z_{12}=Z_{21}$ and the symmetry requires that $Z_{11}=Z_{22}$.

Figure 3:
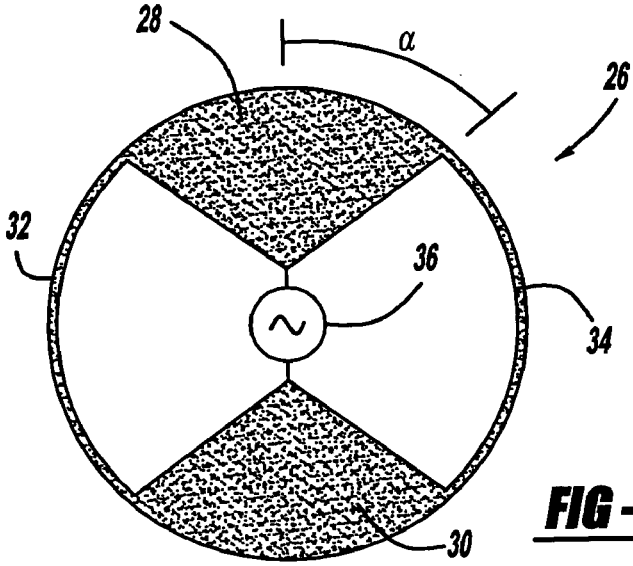
FIG. 3 is a plan view of a coupled sectorial loop antenna, according to an embodiment of the present invention.

FIG. 3 is a CSLA 26 that includes the SLAs 20 and 22 coupled in parallel, according to the invention. In the CSLA 26, V1=V2 and, as a consequence of symmetry, $I_1=I_2=I$. The CSLA 26 includes two pie-slice shaped sectors 28 and 30 and two arches 32 and 34, where the sector 28 is a combination of two of the sectors of the SLAs 20 and 22, the sector 30 is a combination of the two other sectors of the SLAs 20 and 22, the arch 32 is the arch of the SLA 20 and the arch 34 is the arch of the SLA 22. The CSLA 26 is fed by an AC source 36 at the points of the sectors 28 and 30.

The input impedance of the CSLA 26 can be obtained from:

$$Z_{in}=\frac{1}{2}(Z_{11}+Z_{12}) \tag{3}$$

In order to achieve a wideband operation, spectral variations of $Z_{11}$ and $Z_{12}$ must counteract each other. That is, when the real (imaginary) part of $Z_{11}$ increases with frequency, the real (imaginary) part of $Z_{12}$ should decrease so that the average impedance remains constant. This can be accomplished by optimizing the geometrical parameters of the antenna system. $Z_{11}$ and $Z_{12}$ are obtained by calculating the self and mutual impedances of the SLAs 20 and 22 using full-wave FDTD simulations.

FIGS. 4(*a*)-4(*j*) show the real and imaginary parts of $Z_{11}$ and $Z_{12}$ for the CSLAs 20 and 22 and the input impedance of the CSLA 26 as defined by equation (3), where $R_{in}$=13 mm and $R_{out}$=14 mm, for different values of $\alpha$ when they are placed at a distance of d=0.01 $\lambda_{max}$ apart, and where $\lambda_{max}$ is the wavelength of the lowest frequency of operation. Particularly, FIGS. 4(*a*), (*c*), (*e*), (*g*) and (*i*) show the real part for $\alpha$=5°, 20°, 40°, 60° and 80°, respectively, and FIGS. 4(*b*), (*d*), (*f*), (*h*) and (*k*) show the imaginary part for $\alpha$=5°, 20°, 40°, 60° and 80°, respectively. The line 38 is the self-impedance, the line 40 is the mutual impedance and the line 42 is the input impedance as defined by equation (3). The graph lines show that as $C/\lambda$ increases, the variations in the imaginary parts of $Z_{11}$ and $Z_{12}$ counteract each other for $1.5<C/\lambda<4$ and the variations in the real parts of $Z_{11}$ and $Z_{12}$ counteract each other for $2<C/\lambda<3$, where $C=2\pi R_{out}$. This suggests that the bandwidth of the CSLA 26 may be enhanced by choosing $\alpha$ in the range of $20°<\alpha\leqq 80°$.

The optimum geometrical parameters of the CSLA 26 can be determined by an experimental sensitivity analysis. The three parameters that affect the response of the CSLA 26 are the inner radii $R_{in}$ of the arches 32 and 34, the outer radii $R_{out}$ of the arches 32 and 34 and the arc angle $\alpha$. The lowest frequency of operation is determined by the overall effective circumference of the SLA 10 as:

$$f_1=\frac{2c}{(\pi-\alpha+2)\sqrt{\varepsilon_{eff}}\,(R_{in}+R_{out})} \tag{4}$$

Where $\in_{eff}$ is the effective dielectric constant of the antenna surrounding medium and c is the speed of light.

Choosing the lowest frequency of operation, the average radius $R_{av}=(R_{in}+R_{out})/2$ of the CSLA 26 can be determined from equation (4). Therefore the parameters that remain to be optimized are $\alpha$ and $\tau=(R_{out}-R_{in})$. In order to obtain the optimum value of $\alpha$, nine different antennas with $\alpha$ values ranging from 5° up to 80° with $R_{in}$=13 mm and $R_{out}$=14 mm were fabricated and their $S_{11}$ as a function of frequency was measured. It has been discovered that the optimum value of $\alpha$=60° results in the maximum impedance bandwidth for the CSLA 26.

Because the antenna topology of the CSLA 26 needs a balanced feed, half of the CSLA 26 along a plane of zero potential over a ground plane fed by a coaxial cable can be used. FIG. 5 is a plan view of a CSLA 44 including a ground plane 46, a pie-slice shaped sector 48 having its point positioned proximate the ground plane 46, a first arch 50 coupled to the ground plane 46 and one side of the sector 48 opposite to the point, and a second arch 52 coupled to the ground plane 46 and an opposite side of the end of the sector 48 from the point. A feed 54 feeds the point of the sector 48. In one embodiment, the feed 54 is a coaxial cable including an inner connector electrically coupled to the point of the sector 48 and an outer conductor electrically coupled to the ground plane 46. In this non-limiting embodiment, the CSLA 44 is fabricated using printed circuit technology on a thin dielectric substrate having a dielectric constant of $\in_r$=3.4, a length of 3 cm, a width of 1.65 cm and a thickness of 500 μm and is mounted on a 10 cm×10 cm ground plane.

The next step in the optimization process of the CSLA 44 is to find the optimum value of the arch thickness $\tau=R_{out}-R_{in}$. This is accomplished by providing the CSLA 44 with $\alpha$=60°, $R_{av}$=13.5 mm and three different arch thicknesses of $\tau$=0.4, 1.0 and 1.6 mm. It is observed that a thinner arch provides a wider bandwidth. For the thinnest value of $\tau$=0.4 mm, a CSLA with a bandwidth of 3.7 GHz to 11.6 GHz is obtained.

The dimensions of CSLA 44 can be scaled in wavelength to achieve an arbitrarily different frequency band of operation. In one embodiment, the optimum geometrical parameters of the CSLA 44 include $R_{in}$=27.8 mm, $R_{out}$=28 mm and $\alpha$=60°. Also, in one embodiment, the CSLA 44 is mounted on a 20 cm×20 cm ground plane, although the size of the ground plane is arbitrary. The dimensions are increased to lower the lowest and highest frequencies of operation and simplify the radiation pattern measurements. The CSLA 44 has a VSWR lower than 2.1 from 1.78 GHz to 14.5 GHz, which is equivalent to an 8.5:1 impedance bandwidth, when $R_{in}$ is 27.8 mm, $R_{out}$ is 28 mm and $\alpha$=60°, and where the CSLA 44 is fabricated on the end piece of a dielectric substrate having a length of 6 cm, a width of 3 cm, a thickness of 500 μm and $\in_r$ is 3.4. Also, the gain and radiation patterns of the CSLA 44 across the frequency range of operation remain almost constant, particularly over the first two octaves of its impedance bandwidth.

The radiation patterns of the CSLA 44, in the azimuth plane, were measured across the entire frequency band. The radiation patterns remain similar up to about f=8 GHz. As the frequency increases beyond 8 GHz, the radiation patterns start having higher directivities in other directions.

The radiation patterns in the elevation planes were also measured for two principle planes at $\phi$=0°, 180°, 0°≦θ≦180° and $\phi$=90°, 270°, 0°≦θ≦180° at 2 GHz, 4 GHZ, 6 GHz, 8 GHz, 10 GHz, 12 GHz, 14 GHz and 16 GHz. As frequency increases, the electrical dimensions of the CSLA 44 increase, and thus, the number of lobes increases. Also, the number of minor sidelobes in the back of the ground plane (90°≦θ≦180°) increases significantly. This is caused by diffractions from the edge of the ground plane, which has very large electrical dimensions at higher frequencies.

At lower frequencies, the radiation patterns are symmetric. However, as the frequency increases, the symmetry is not observed very well. This is caused by the coaxial cable that feeds the CSLA 44 because it disturbs the symmetry of the measurements. Since the cable is electrically large at higher frequencies, a more pronounced asymmetry on the radiation patterns are observed at higher frequencies. In all of the measured radiation patterns, the cross polarization level ($E_\phi$) is shown to be neglible. This is an indication of good polarization purity across the entire frequency band.

It is desirable to reduce the size and weight of the CSLA 44 by modifying its geometry. The CSLA 44 discussed above was optimized to achieve the highest bandwidth allowing variation of only two independent parameters. Size reduction is important for applications where the wavelength is large, such as ground penetrating radar or high frequency (HF) broadcast antennas. To examine the ways to reduce the size and weight of the CSLA 44, the current distribution over metallic surfaces of the CSLA 44 was calculated. The electric currents on the surface of the CSLA 44 can be computed using a full-wave simulation tool based on the method of moments.

It is noticed that the current magnitude is very small over a sector in the range of 0°≦θ≦30°. This suggests that this portion of the sector 48 of the CSLA 44 can be removed without significantly disturbing the current distribution of the CSLA 44.

Figure 6:
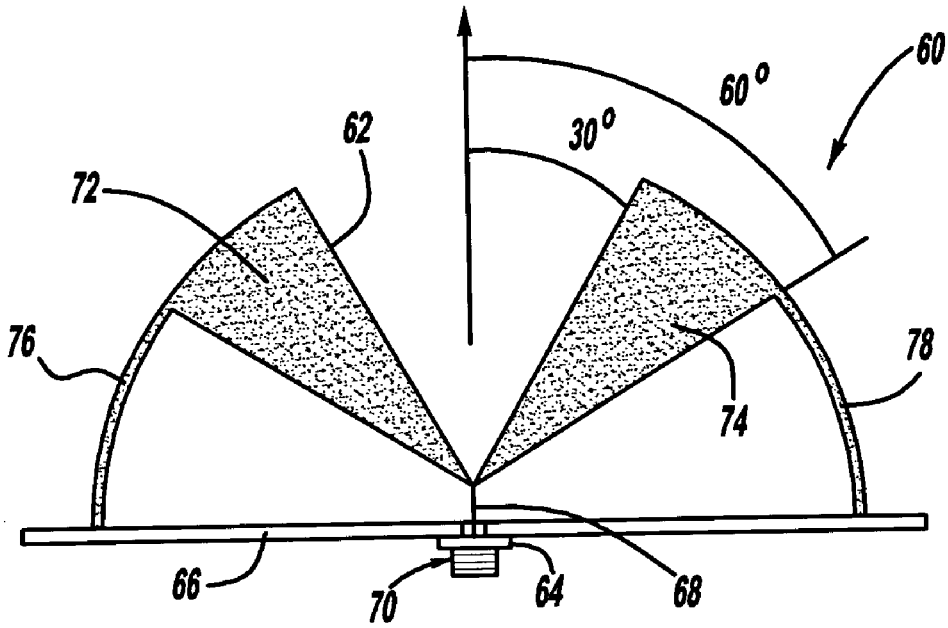
FIG. 6 is a plan view of a CSLA and associated ground plane, according to another embodiment of the present invention.

FIG. 6 is a plan view of a CSLA 60 including a ground plane 66, where a portion 62 in the range of 0°≦θ≦30° is removed from a coupled sector, such as the sector 48, to provide separated sectors 72 and 74. An arch 76 is coupled to the ground plane 66 and the sector 72 and an arch 78 is coupled to the ground plane 66 and the sector 74, as shown. In this non-limiting embodiment, the sectors 72 and 74 have an arc angle of 30° and the portion 62 has an arc angle of 60°. The CSLA 60 includes a coaxial connector 70 that a coaxial cable can be attached to, where an outer conductor 64 of the connector 70 is electrically coupled to the ground plane 66 and an inner conductor 68 of the connector 70 is electrically coupled to points of the sectors 72 and 74.

Figure 7:
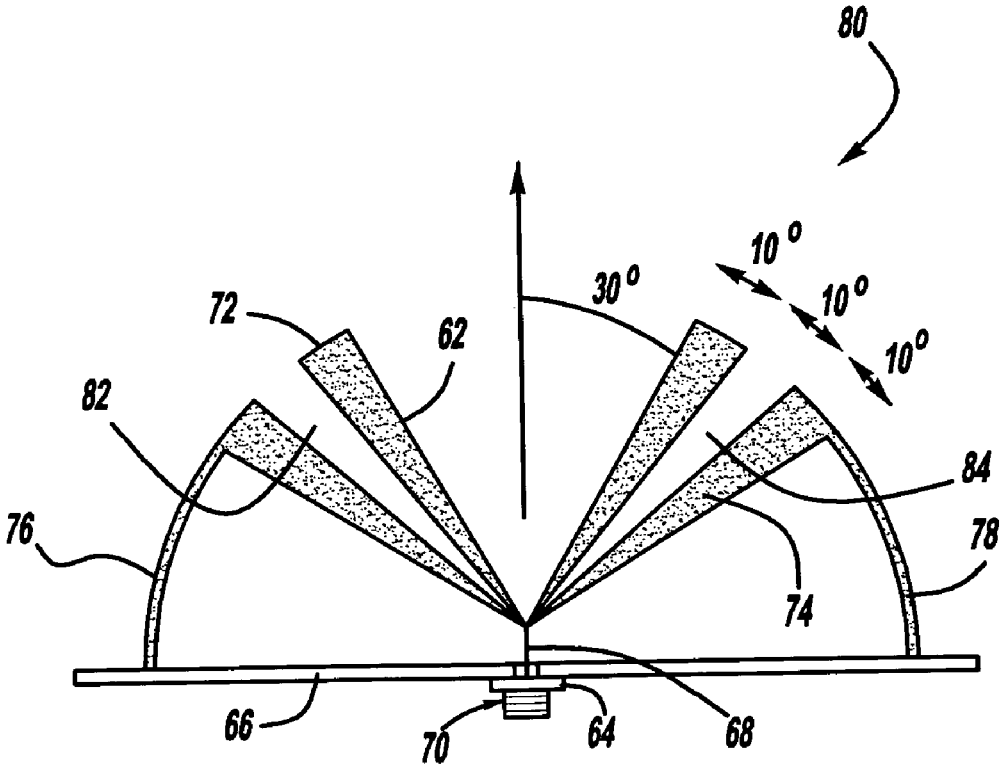
FIG. 7 is a plan view of a CSLA and associated ground plane, according to another embodiment of the present invention.

Applying the same approach and examining the current distribution reveals that the electric current density is larger around θ=30° and θ=60°, and has lower values in the area of 30°<θ<60°. Therefore, a section of the sectors 72 and 74 that is confined in the range 40°<θ<50° can be removed to obtain a CSLA 80 shown in FIG. 7. In the CSLA 80, like elements to the CSLA 60 are identified by the same reference numeral. In this embodiment, the insides of the pie-slice sections 82 and 84 are removed from the sectors 72 and 74, respectively, as shown.

Figure 8:
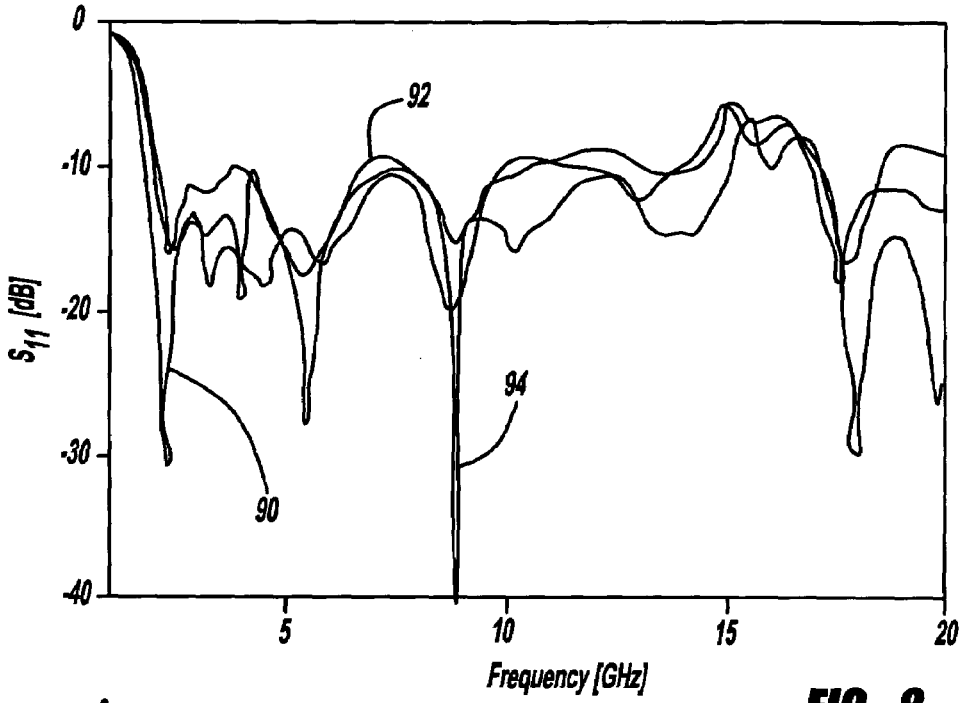
FIG. 8 is a graph with frequency on the horizontal axis and input reflection coefficients in dB scale on the vertical axis showing measured $S_{11}$ values for the CSLAs of the present invention.

The measured S11s of the CSLA 44, the CSLA 60 and the CSLA 80 are shown in FIG. 8, where graph line 90 is for the CLSA 44, graph line 92 is for the CSLA 60 and graph line 94 is for the CSLA 80. FIG. 8 shows that all of the CSLAs 44, 60 and 80 have VSRs lower than 2.2 in the frequency range of 2-14 GHz, as shown in Table 1 below. The best input match is, however, observed for the CSLA 60 with a VSWR lower than 2 across its entire band of operation.

TABLE 1

| Antenna Type | Frequency Range | BW | Highest VSWR |
|---|---|---|---|
| CSLA 44 | 1.7-14.5 GHz | 8.5:1 | 2.2 |
| CSLA 60 | 2.14.7 GHz | 7.35:1 | 2.2 |
| CSLA 80 | 2.05-15.3 GHz | 7.46:1 | 2.2 |

Figure 9:
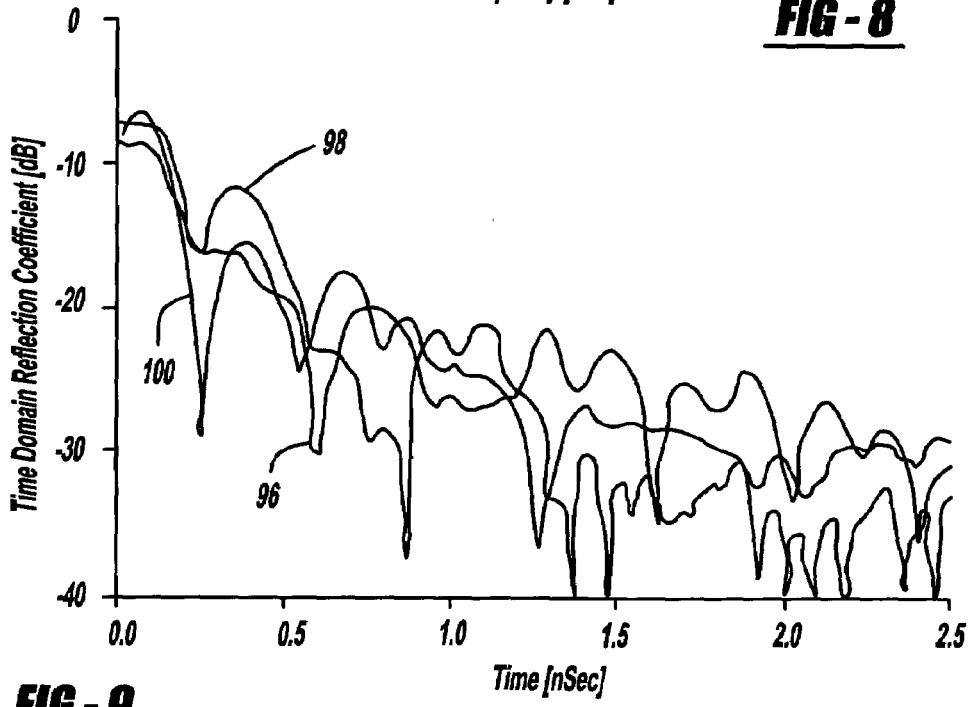
FIG. 9 is a graph with time on the horizontal axis and time domain reflection coefficient on the vertical axis showing the time domain reflection coefficients of the CSLAs of the present invention.

The CSLAs 44, 60 and 80 provide a very wide bandwidth. However, having a wideband frequency-domain response does not necessarily ensure that the CSLAs 44, 60 and 80 behave well in the time-domain, that is, a narrow time-domain pulse is not widened by the CSLAs 44, 60 and 80. Some multi-resonant wideband antennas, such as log-periodic antennas, due to multiple reflections within the antenna structure widen a narrow pulse in the time domain. Therefore, in order to ensure the usefulness of the CSLAs 44, 60 and 80 for time domain applications, the time-domain response of the CSLA must also be examined. FIG. 9 shows the time-domain variation of the reflection coefficient ρ of the CSLAs 44, 60 and 80. In FIG. 9, graph line 96 is for the CSLA 44, graph line 98 is for the CSLA 60 and graph line 100 is for the CSLA. 80.

The CSLAs 44, 60 and 80 show the maximum reflection at t=0 ns, which corresponds to the discontinuity at the plane of calibration. The peak reflection at t=80 ps corresponds to the probe-antenna transition. The CSLA 60 has a similar behavior to the behavior of the CSLA 44. However, the CSLA 60 shows more small reflections. The increase in the number of small reflections is a consequence of the larger number of discontinuities in the antenna structure. In addition to the input reflection coefficient, transmission coefficients for two similar CSLAs were also measured.

Figure 10:
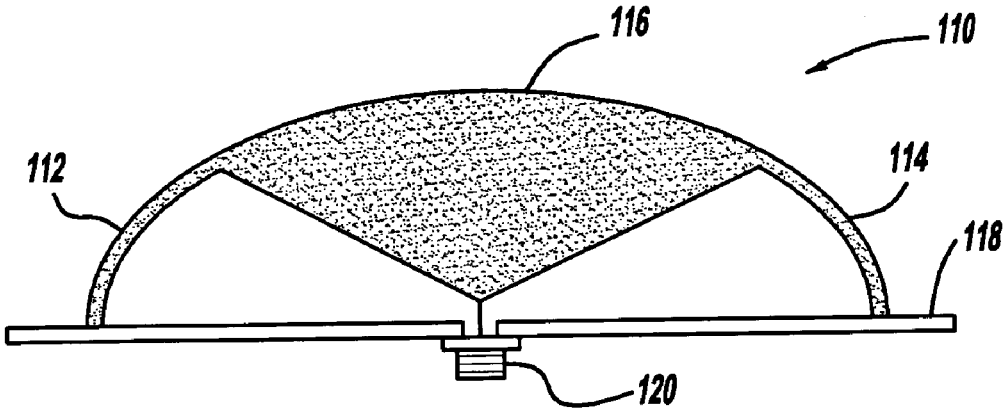
FIG. 10 is a plan view of a CSLA and associated ground plane, where the CSLA has an oval configuration, according to another embodiment of the present invention.

The CSLAs 44, 60 and 80 all have a circular orientation, i.e., the arches and sectors define a portion of a circle. It may be desirable to reduce the height of the CSLA for certain applications, such as for a vehicle platform. FIG. 10 is a plan view of a CSLA 110 depicting such an embodiment. The CSLA 110 includes an arch 112, an arch 114, a pie-slice shaped sector 116 and a ground plane 118. An outer conductor of a coaxial connector 120 is coupled to the ground plane 118 and an inner conductor of the coaxial connector 120 is coupled to the point of the sector portion 116. The orientation of the arches 112 and 114 and the sector portion 116 define an elliptical configuration, as depicted.

Figure 11:
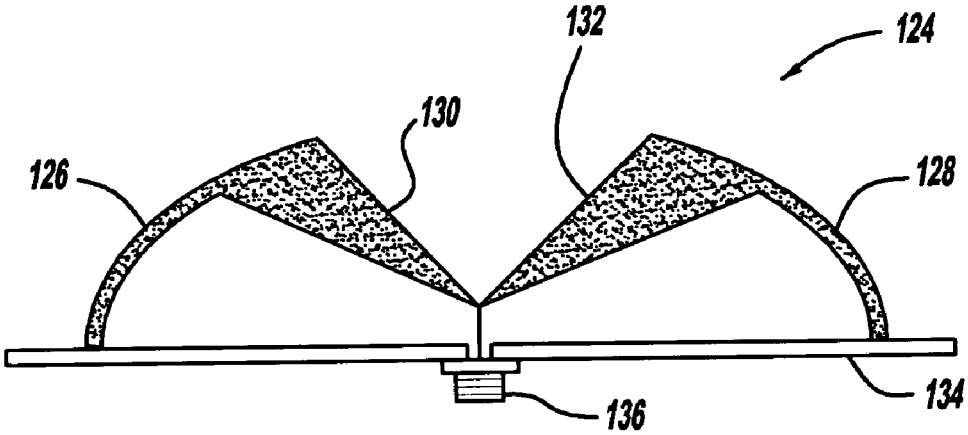
FIG. 11 is a plan view of a CSLA and associated ground plane, where a portion of the sector has been removed and the CSLA has an oval configuration, according to another embodiment of the present invention.

The elliptical orientation of the CSLA 110 can also be extended to the embodiment of the CSLA 60. Particularly, FIG. 11 is a plan view of a CSLA 124 including an arch 126, an arch 128, a first pie-slice shaped sector 130, a second pie-slice shaped sector 132, a ground plane 134 and a coaxial connector 136.

The arch angle $\alpha$ and $R_{in}$ and $R_{out}$ for the arches 112, 114, 126 and 128 can be those discussed above or other values for other applications, which may depend on the frequency band of interest. In one embodiment, the CSLAs 110 and 124 are about 4 m in length and about 1 m in height and are tuned to a VHF band of 20 MHz-90 MHz.

Figure 12:
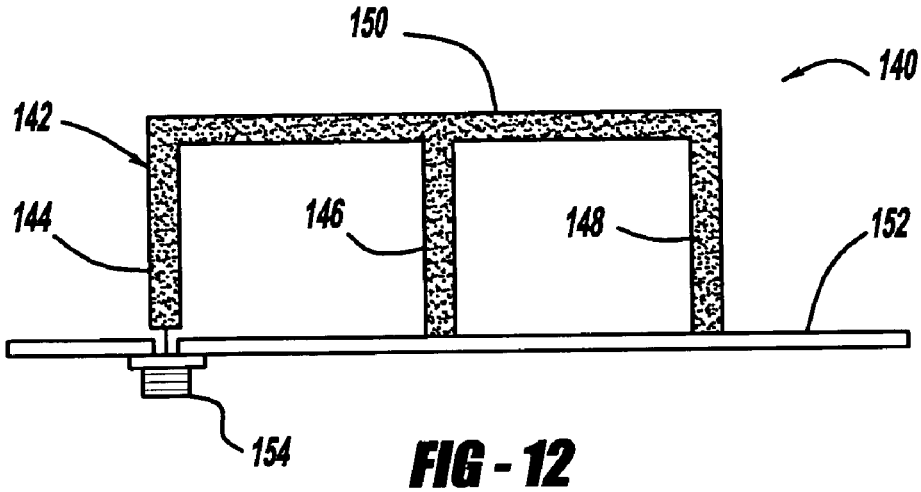
FIG. 12 is a plan view of an E-shaped CSLA and associated ground plane, according to another embodiment of the present invention.

FIG. 12 is a plan view of a wide-band E-shaped double-loop antenna 140, according to another embodiment of the present invention. The antenna 140 includes a metal trace 142 printed on a dielectric substrate, where the metal trace 142 includes legs 144, 146 and 148, and a cross-bar 150. The legs 146 and 148 are electrically coupled to a ground plane 152, and the leg 144 is electrically coupled to a center conductor of a coax connector 154. An outer conductor of the connector is electrically coupled to the ground plane 152. The E-shaped double-loop antenna 140 provides an ultra-wide bandwidth similar to the CSLAs discussed above, but has a low profile and is lightweight.

Figure 13:
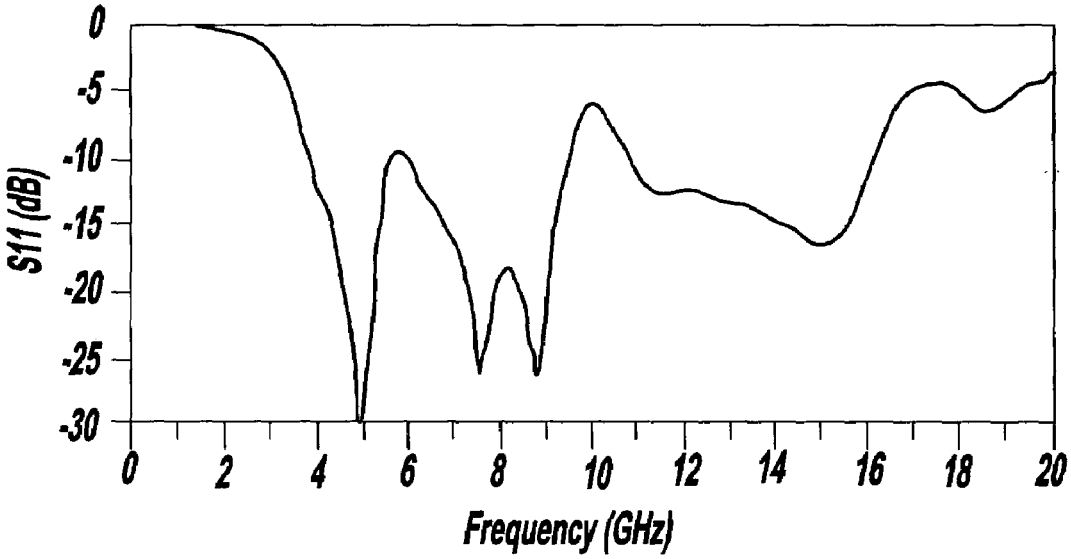
FIG. 13 is a graph with frequency on the horizontal axis and return loss on the vertical axis showing the measured return loss of the CSLA of FIG. 12.

FIG. 13 is a graph with frequency on the horizontal axis and measured return loss (S11) on the vertical axis showing the measured return loss of the antenna 140.

Figure 14:
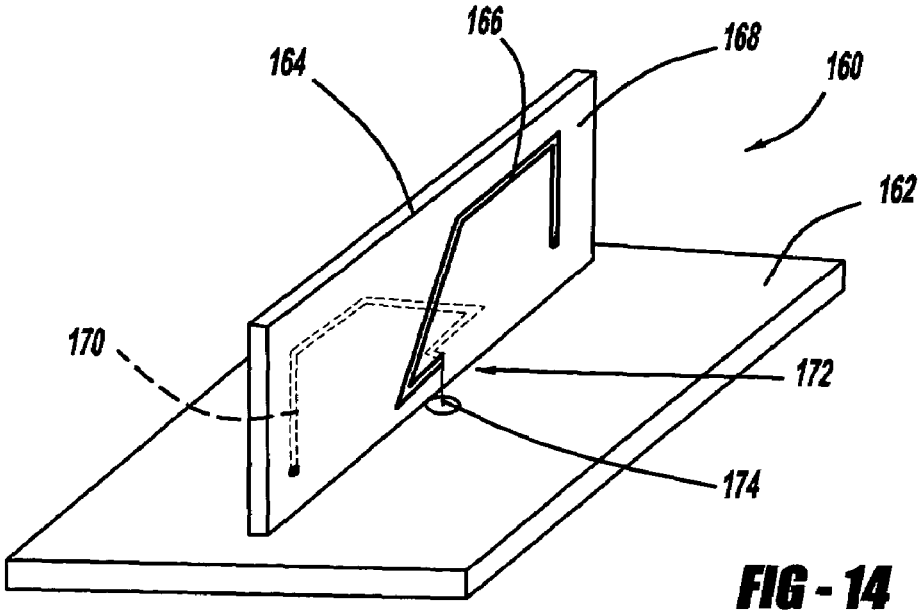
FIG. 14 is a perspective view of a CSLA having overlapped antenna traces, according to another embodiment of the present invention.

In order to reduce the length of the CSLA, arms of the antenna can be printed on two sides of a substrate and create an overlap between the arms. FIG. 14 is a perspective view of a two-sided overlapped CSLA 160 depicting this embodiment. The CSLA 160 includes a ground plane 162 and a dielectric substrate 164 mounted substantially perpendicular thereto. A first arm metal trace 166 is deposited on a first side 168 of the substrate 164 and a second arm metal trace 170 is deposited on an opposite side of the substrate 164. The arm traces 166 and 170 overlap at a center area 172 of the CSLA 160 to provide the reduced length. The metal traces 166 and 170 are connected to each other at feedline 174. The configuration of the metal traces 166 and 170 are deformed into a piece-wise linear manner to provide more degrees of freedom in the design including the height of the traces 166 and 170, the length of the traces 166 and 170 and the angle of the crossover portion 172 of the arm traces 168 and 170.

Figure 15:
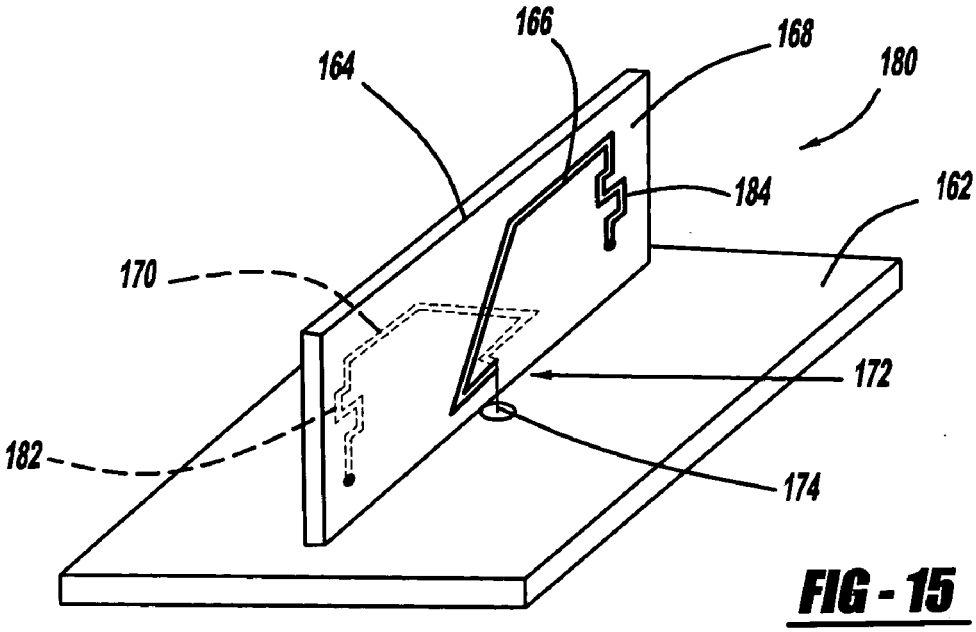
FIG. 15 is a CSLA of the type shown in FIG. 14 including inductively loaded antenna traces, according to another embodiment of the present invention.

A resonant segment of a transmission line can be considered a resonant LC circuit. The length of the transmission line provides the inductance L. If an inductor is added to the end of the transmission line, it is possible to shorten the length of the line while maintaining the desired resonance. Therefore, the size of the CSLA 160 can be further reduced by adding inductors to the traces 168 and 170. A perspective view of a CSLA 180 is shown in FIG. 15 depicting this embodiment. Particularly, an inductor 182 is added to the end of the trace 170 opposite to the feedline 174, and an inductor 184 is added to the end of the trace 166 opposite to the feedline 174. Both lumped inductors and distributed inductors using printed loops can be used at the two sides of the substrate and connected therethrough by vias.

Figure 16:
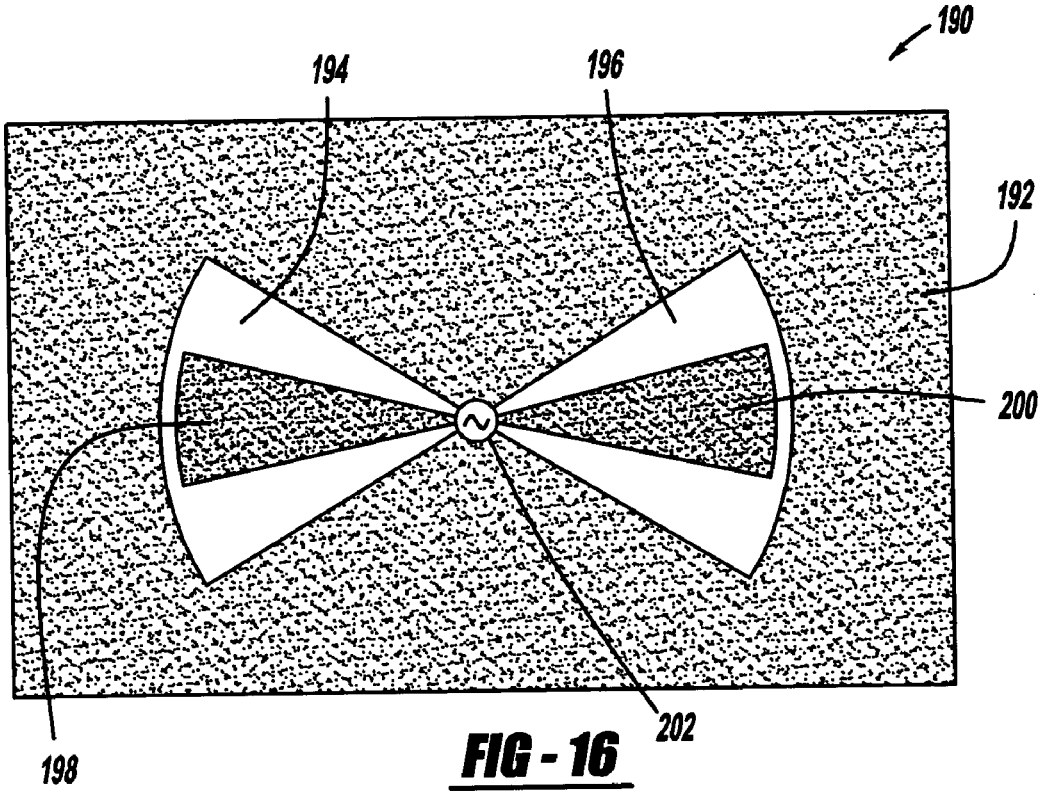
FIG. 16 is a top view of a dual slot CSLA, according to another embodiment of the present invention.

The several antennas discussed above have all been based on printed metal on a dielectric substrate. In an alternate embodiment, the various CSLAs discussed above can be based on slot antenna designs printed on a ground plane. FIG. 16 is a top view of a dual slot CSLA 190 illustrating this embodiment. The CSLA 190 includes a metallized ground plane 192 formed on a dielectric substrate. Pie-slice shaped portions 194 and 196 are removed from the ground plane 192, where a pie-slice shaped sector 198 is left within the portion 194 to be electrically isolated from the remaining portion of the ground plane 192, and a pie-shaped sector 200 is left in the pie-slice shaped portion 196 and is also electrically isolated from the remaining portion of the ground plane 192. The sectors 198 and 200 are fed by an AC source 202 at their points, as shown. The CSLA 190 provides the advantage of being conformal and can be printed on curved surfaces. Further, the CSLA 190 provides horizontal polarization. This can be particularly useful for polarimetric SAR systems, where two orthogonal antennas are required. The dual slot CSLA 190 can coexist with other CSLAs discussed above to provide both polarizations.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A sectorial loop antenna comprising:

a ground plane;

a pie-slice shaped sector having a point positioned adjacent to the ground plane;

a first arch coupled to the ground plane and one side of the sector opposite to the point;

a second arch coupled to the ground plane and an opposite side of the sector opposite to the point; and a feed electrically coupled to the point of the sector and electrically isolated from the ground plane.

2. The antenna according to claim 1 wherein the sector has an arc angle of about 120°.

3. The antenna according to claim 1 wherein an input impedance of the feed is a function of $R_{in}$, $R_{out}$ and $\alpha$ of the sector, where $R_{in}$ is the inner radius of the arches, $R_{out}$ is the outer radius of the arches and $\alpha$ is the arc angle in degrees of half of the sector.

4. The antenna according to claim 3 wherein $R_{in}$=27.8 mm, $R_{out}$=28 mm and $\alpha$=60.

5. The antenna according to claim 3 wherein the thickness of the first and second arches is about 0.4 mm.

6. The antenna according to claim 1 wherein the first arch, the second arch and the sector define an elliptical configuration.

7. The antenna according to claim 1 wherein the first arch, the second arch and the sector define a circular configuration.

8. The antenna according to claim 1 wherein the coupled sectorial loop antenna has an 8.5:1 impedance bandwidth.

9. The antenna according to claim 1 wherein the feed includes a coaxial connector, wherein an inner conductor of the coaxial connector is coupled to the point of the sector and an outer conductor of the coaxial connector is coupled to the ground plane.

10. A coupled sectorial loop antenna comprising:

a ground plane;

a first pie-slice shaped sector and a second pie-slice shaped sector each having a point positioned adjacent to the ground plane and defining a pie-sliced shaped open portion therebetween;

a first arch electrically coupled to the ground plane and an end of the first sector opposite to the point of the first sector;

a second arch electrically coupled to the ground plane and an end of the second sector opposite to the point of the second sector; and a feed electrically coupled to both points of the first and second sectors and electrically isolated from the ground plane.

11. The antenna according to claim 10 wherein the open portion is between −30° and +30° relative to a radius that bisects the open portion.

12. The antenna according to claim 10 wherein the first and second sectors have an arc angle of 30°.

13. The antenna according to claim 10 wherein a portion of the first and second sectors is removed.

14. The antenna according to claim 13 wherein the removed portions of the sectors are between 40° and 50° of the first sector and −40° and −50° of the second sector relative to a radius that bisects the open portion.

15. The antenna according to claim 10 wherein an input impedance of the feed is a function of $R_{in}$, $R_{out}$ and $\alpha$ of the first and second sectors, where $R_{in}$ is the inner radius of the arches, $R_{out}$ is the outer radius of the arches and $\alpha$ is an arc angle in degrees.

16. The antenna according to claim 15 wherein $R_{in}$=27.8 mm, $R_{out}$=28 mm and $\alpha$=60°.

17. The antenna according to claim 10 wherein the thickness of the arches is about 0.4 mm.

18. The antenna according to claim 10 wherein the first arch, the second arch and the sector define an elliptical configuration.

19. The antenna according to claim 10 wherein the first arch, the second arch and the sector define a circular configuration.

20. The antenna according to claim 10 wherein the coupled sectorial loop antenna has an 8.5:1 impedance bandwidth.

21. The antenna according to claim 10 wherein the feed includes a coaxial connector, wherein an inner conductor of the coaxial connector is coupled to the point of the sectors and an outer conductor of the coaxial connector is coupled to the ground plane.

22. A sectorial loop antenna comprising:

a ground plane;

a pie-slice shaped sector having a point positioned adjacent to the ground plane, said pie-slice shaped sector including at least one pie-slice shaped portion being removed therefrom;

a first arch coupled to the ground plane and one side of the sector opposite to the point;

a second arch coupled to the ground plane and an opposite side of the sector opposite to the point; and a feed electrically coupled to the point of the sector and electrically isolated from the ground plane.

23. The antenna according to claim 22 wherein the at least one removed portion from the sector is a single removed portion centrally located within the sector.

24. The antenna according to claim 23 wherein the removed portion from the sector is between −30° and +30° relative to a radius that bisects the sector.

25. The antenna according to claim 22 wherein the removed portion of the sector is three removed portions.

26. The antenna according to claim 25 wherein the removed portions of the sector include a center removed portion between −30° and +30° relative to a radius that bisects the sector, a first side removed portion between 40° and 50° relative to the radius on one side of the center removed portion and a second side removed portion between −40° and −50° relative to the radius on the other side of the center removed portion.

27. The antenna according to claim 22 where the sector has an arch angle of about 120°.

28. The antenna according to claim 22 wherein the first arch, the second arch and the sector define an elliptical configuration.

29. The antenna according to claim 22 wherein the first arch, the second arch and the sector define a circular configuration.

30. The antenna according to claim 22 wherein the feed includes a coaxial connector, wherein an inner conductor of the coaxial connector is coupled to the point of the sector and an outer conductor of the coaxial connector is coupled to the ground plane.

* * * * *